US006982624B2

(12) United States Patent
Saito et al.

(10) Patent No.: US 6,982,624 B2
(45) Date of Patent: Jan. 3, 2006

(54) CHIP RESISTOR

(75) Inventors: Daisuke Saito, Kyoto (JP); Takahiro Kuriyama, Kyoto (JP); Masato Doi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/786,386

(22) Filed: Feb. 23, 2004

(65) Prior Publication Data

US 2004/0164841 A1 Aug. 26, 2004

(30) Foreign Application Priority Data

Feb. 25, 2003 (JP) ..... 2003-047518

(51) Int. Cl.
*H01C 1/012* (2006.01)

(52) U.S. Cl. ..... 338/309; 338/332; 338/313

(58) Field of Classification Search ..... 338/332, 338/313, 309

See application file for complete search history.

(56) References Cited

U.S. PATENT DOCUMENTS 5,815,065 A * 9/1998 Hanamura ..... 338/309
6,023,217 A * 2/2000 Yamada et al. ..... 338/309
6,150,920 A * 11/2000 Hashimoto et al. ..... 338/309
6,153,256 A * 11/2000 Kambara et al. ..... 427/103
6,359,546 B1 * 3/2002 Oh ..... 338/313
6,492,896 B2 * 12/2002 Yoneda ..... 338/309
6,703,683 B2 * 3/2004 Tanimura ..... 257/536
6,724,295 B2 * 4/2004 Tsukada ..... 338/309
2003/0117258 A1 * 6/2003 Kim et al. ..... 338/309
2003/0147200 A1 * 8/2003 Harada et al. ..... 361/321.4

FOREIGN PATENT DOCUMENTS

JP 2002-184602 6/2002

* cited by examiner

*Primary Examiner*—Karl D. Easthom
(74) *Attorney, Agent, or Firm*—Hamre, Schumann, Mueller & Larson, P.C.

(57) ABSTRACT

A chip resistor includes an insulating chip substrate, a resistor film formed on the substrate, a pair of upper electrodes formed from silver paste to be connected to the resistor film, a cover coat covering the resistor film, an auxiliary electrode formed on each of the upper electrodes to partially overlap the cover coat, a side electrode formed on each of the side surfaces of the substrate to be connected to the upper electrode and the auxiliary electrode, a nickel-plated layer covering the auxiliary electrode and the side electrode, and a soldering layer covering the nickel-plated layer. The side electrode is made from nonmagnetic conductive resin paste, whereas the auxiliary upper electrode is made from carbon-based conductive resin paste.

6 Claims, 3 Drawing Sheets

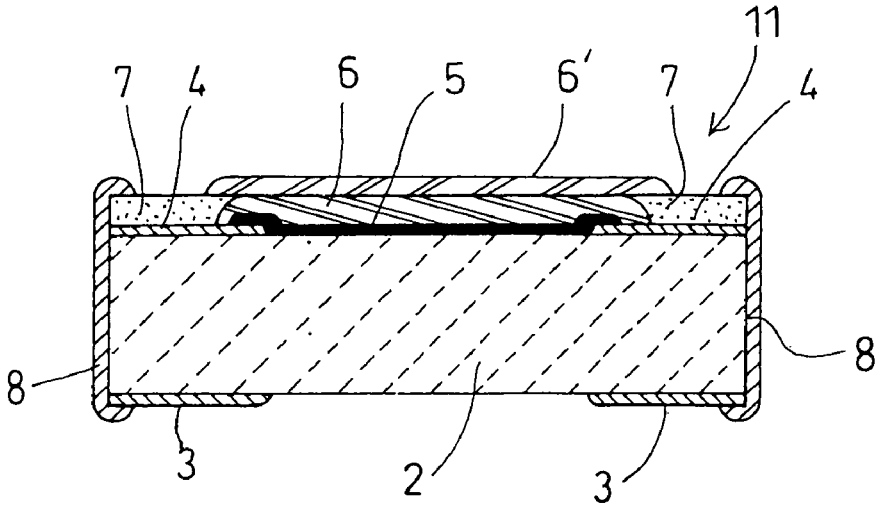
Fig. 3
Fig. 4
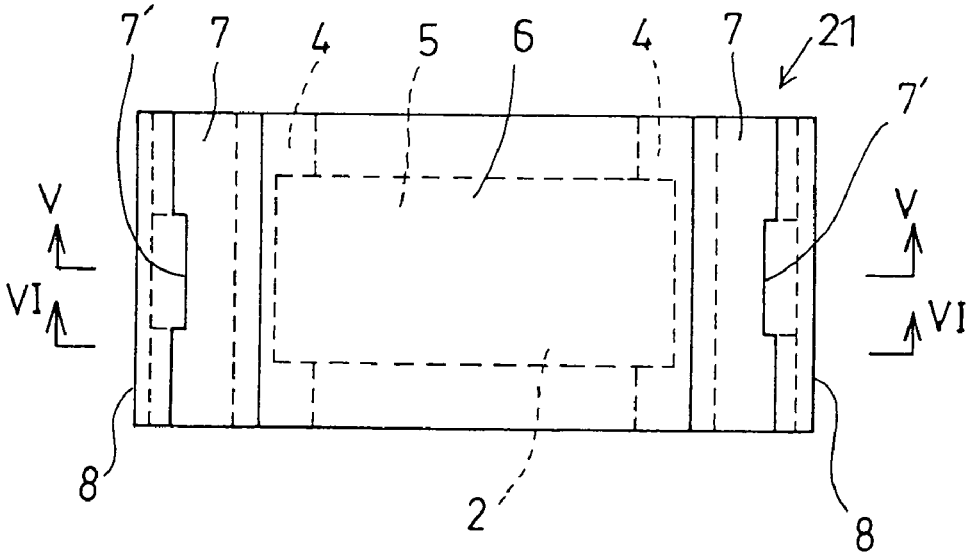

CHIP RESISTOR

BACKGROUND OF THE INVENTION

1. Field of the Invention

The present invention relates to a chip resistor comprising an insulating substrate in the form of a chip, at least one resistor film formed on the substrate, terminals provided at opposite ends of the resistor film, and a cover coat covering the resistor film.

2. Description of the Related Art

Conventionally, in a chip resistor of the above-described type, the cover coat covering the resistor film projects largely from a central portion of the upper surface of the insulating substrate, thereby providing stepped portions in the chip resistor. The stepped portions cause such a problem that a collet of a vacuum suction type cannot duly suck the chip resistor or that the collet may break the cover coat when the chip resistor is to be mounted on a printed circuit board.

There is another problem as follows. The terminals provided at opposite ends of the resistor film include upper electrodes formed on the upper surface of the insulating substrate for connection to the resistor film. Generally, the upper electrodes are made of conductive paste containing silver as the main ingredient. (Hereinafter, the paste is referred to as "silver-based conductive paste," or more simply "silver paste"). Therefore, although the upper electrodes are covered with metal plating layers, corrosion such as migration due to e.g. sulfur in the air may occur at the upper electrodes. Specifically, silver in the upper electrodes reacts with sulfur gas such as hydrogen sulfide in the air to form silver sulfide. Such corrosion may lead to a break in the upper electrodes.

JP-A-2002-184602 discloses a chip resistor capable of solving the above-described problems. Specifically, in the disclosed chip resistor, an auxiliary upper electrode made of nickel-based conductive paste, or nickel paste, which does not contain silver is formed on each of the upper electrodes to partially overlap the cover coat. With this arrangement, the difference in height at the stepped portions is eliminated or reduced, and the corrosion of the upper electrodes are prevented.

A chip resistor of the above type, in addition to the upper electrodes, includes a side electrode made of silver paste, the side electrode provided on a side surface of the insulating substrate for connection to the upper electrode. For facilitating the soldering of the chip resistor, the upper electrode and the side electrode are covered with a metal coating consisting of an underlying nickel-plated layer and an upper layer formed by tin-plating or solder-plating on the nickel-plated layer.

The provision of the nickel-plated layer as the base is important for preventing the upper electrode and the side electrode from being eroded due to soldering. In light of this, conventionally, it is necessary to check, after the nickel-plated layer forming step, whether or not the desired nickel layer has been formed. Since nickel is a ferromagnetic metal, an accurate check for the formation of the nickel-plated layer can be made at low cost with a relatively simple checking system utilizing a magnet.

However, when the auxiliary upper electrode made of nickel paste is formed on the upper electrode as disclosed in JP-A-2002-184602, the formation of the nickel-plated layer cannot be checked with the above-described checking system utilizing a magnet. Instead, the checking need be performed with the use of a more complicated and expensive system.

When the auxiliary upper electrode is made of a silver or copper paste, it may be corroded by the airborne sulfur compounds, so that the corrosion of the upper electrode cannot be prevented completely.

SUMMARY OF THE INVENTION

An object of the present invention is to solve the above-described problems.

According to the present invention, there is provided a chip resistor comprising: an insulating chip substrate including an upper surface and a pair of opposite side surfaces; a resistor film formed on the upper surface of the insulating substrate; a pair of upper electrodes formed from silver-based conductive paste on the upper surface of the insulating substrate to be connected to the resistor film; a cover coat covering the resistor film; an auxiliary electrode formed on each of the upper electrodes to partially overlap the cover coat; a side electrode formed on each of the side surfaces of the insulating substrate and electrically connected to one of the upper electrodes and one of the auxiliary upper electrodes; a nickel-plated layer covering the auxiliary electrode and the side electrode; and a soldering layer covering the nickel-plated layer and formed of tin or solder. The side electrode is made of nonmagnetic conductive resin paste, whereas the auxiliary upper electrode is made of carbon-based conductive resin paste.

With this structure, the provision of the nickel-plated layer can be checked accurately and at low cost by a checking system utilizing a magnet, since the side electrode is made of nonmagnetic conductive resin paste and the auxiliary upper electrode is made of carbon-based conductive resin paste.

Further, since the auxiliary upper electrode is made of carbon-based conductive resin paste, corrosion such as migration due to e.g. sulfur in the air can be prevented from occurring at the auxiliary upper electrode.

In the above arrangement, the upper electrode is made of silver-based conductive paste having a relatively low electric resistance. However, the provision of the auxiliary upper electrode made of carbon-based conductive resin paste on the upper electrode can prevent the corrosion of the upper electrode, which would otherwise occur due to the airborne sulfur compounds.

Preferably, the side electrode may be made from carbon-based conductive resin paste so that the sulfur-causing corrosion does not occur at the side electrode.

The chip resistor of the present invention may further include a pair of lower electrodes formed of carbon-based conductive resin paste on the lower surface of the insulating substrate to be connected to the side electrodes. Each of the lower electrode is enclosed by an underlying nickel-plated layer and a soldering layer formed on the underlying layer. The soldering layer may be made by plating tin or solder.

With this arrangement, it is possible to prevent the lower electrode from suffering the corrosion caused by the airborne sulfur.

Preferably, the chip resistor of the present invention may further include an overcoat covering the cover coat and partially overlapping the auxiliary upper electrodes. In this case, the overcoat prevents sulfur in the air from entering through the contact portion between the auxiliary upper electrode and the cover coat. Therefore, the corrosion of the upper electrode can be prevented more reliably.

Preferably, the auxiliary upper electrode may be formed with a cutout for allowing the side electrode to come into direct contact with the upper electrode. With this structure, when the chip resistor is mounted onto a printed circuit board, an electric current can flow from a wiring pattern on the printed circuit board to the resistor film of the chip resistor through the side electrode and the upper electrode, i.e., without passing through the auxiliary upper electrode. In this manner, it is possible to prevent the auxiliary electrode from significantly varying the pre-adjusted resistance of the chip resistor.

Other features and advantages of the present invention will become clearer from the detailed description given below with reference to the accompanying drawings.

BRIEF DESCRIPTION OF THE DRAWINGS

FIG. 3 is a sectional view illustrating a chip resistor according to a second embodiment of the present invention;

FIG. 4 is a plan view illustrating a chip resistor according to a third embodiment of the present invention;

DETAILED DESCRIPTION OF THE PREFERRED EMBODIMENTS

Figure 1:
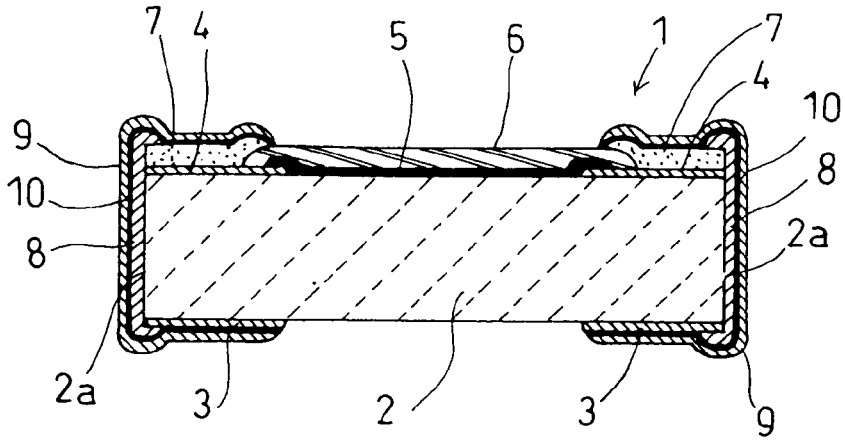
FIG. 1 is a sectional view illustrating a chip resistor according to a first embodiment of the present invention.

Referring to FIG. 1, a chip resistor 1 according to a first embodiment of the present invention includes an insulating substrate 2 in the form of a chip having a lower surface formed with a pair of lower electrodes 3, and an upper surface formed with a resistor film 5 and a pair of upper electrodes 4 flanking and connected to the resistor film 5. The chip resistor 1 further includes a cover coat 6 made of e.g. glass for covering the resistor film 5. Each of the upper electrodes 4 has an upper surface formed with an auxiliary upper electrode 7 which overlaps part of the cover coat 6. The insulating substrate 2 has opposite side surfaces 2*a* each of which is formed with a side electrode 8 electrically connected to at least the lower electrode 3 and the auxiliary upper electrode 7. The lower electrode 3, the auxiliary upper electrode 7 and the side electrode 8 are covered with a plating layer 9 made of tin or solder for facilitating soldering, with a nickel-plated layer 10 intervening as an underlying layer.

The lower electrodes 3 and the upper electrodes 4 are made of silver-based conductive paste, or silver paste. The side electrodes 8 are made of nonmagnetic conductive resin paste prepared by mixing nonmagnetic metal powder or carbon powder in resin paste for providing conductivity. The auxiliary upper electrodes 7 are made of carbon-based conductive resin paste, or carbon paste, prepared by mixing carbon powder in resin paste for providing conductivity.

With this arrangement, corrosion such as migration due to e.g. sulfur in the air can be prevented from occurring at the auxiliary upper electrodes 7, hence at the upper electrodes 4.

Only the nickel-plated layer 10 is magnetic, while the auxiliary upper electrode 7 and the side electrode 8 are made of a nonmagnetic material. Thus, the provision of the nickel-plated layers 10 can be checked by a checking system utilizing a magnet.

Figure 2:
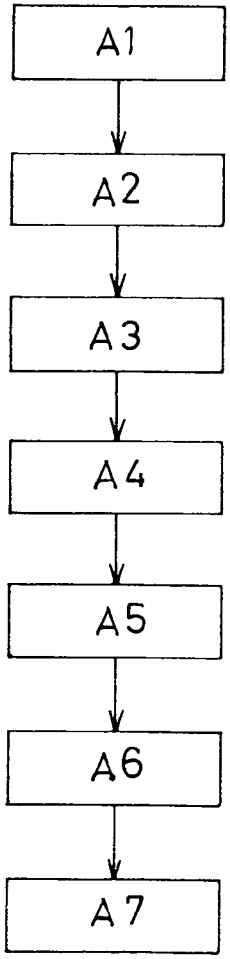
FIG. 2 illustrates the order of process steps for making the chip resistor according to the first embodiment of the present invention.

The chip resistor 1 can be made by the process steps performed in the order shown in FIG. 2.

Specifically, in the first step A1, lower electrodes 3 and upper electrodes 4 are formed on an insulating substrate 2 by screen-printing silver paste and then baking the paste at high temperature. In this step, the lower electrodes 3 may be formed before forming the upper electrodes 4, or the lower electrodes 3 and the upper electrodes 4 may be formed simultaneously.

In the second step A2, a resistor film 5 is formed on the upper surface of the insulating substrate 2 by screen-printing appropriate paste and then baking the paste at high temperature. Thereafter, the resistor film 5 is subjected to trimming for adjusting the resistance to an appropriate value.

In the third step A3, a cover coat 6 to cover the resistor film 5 is formed on the insulating substrate 2 by screen-printing glass paste and then baking the paste at the softening temperature of the glass. Alternatively, the cover coat 6 may be formed by screen-printing an appropriate heat-resistant resin material and then hardening the resin by heating, for example.

In the fourth step A4, auxiliary upper electrodes 7 are formed on the upper electrodes 4*by* screen-printing carbon paste and then hardening the paste by heating, for example.

In the fifth step A5, side electrodes 8 are formed on opposite side surfaces 2*a* of the insulating substrate 2 by screen-printing nonmagnetic conductive resin paste and then hardening the paste by heating, for example.

In the sixth step A6, nickel-plated layers 10 are formed to cover the lower electrodes 3, the auxiliary upper electrodes 7 and the side electrodes 8 by barrel plating.

In the seventh step A7, plating layers 9 for soldering are formed on the nickel-plated layers 10 by barrel plating using tin or solder, whereby the chip resistor 1 is completed.

In the first embodiment, the side electrodes 8 may be made of carbon paste, similarly to the auxiliary upper electrodes 7. In this case, the sulfur-caused corrosion can be prevented from occurring at the side electrodes 8.

Further, in the first embodiment, the lower electrodes 3 may be made of carbon paste, similarly to the auxiliary upper electrodes 7. In this case, the sulfur-caused corrosion can be prevented from occurring at the lower electrodes 3.

In the case where the lower electrodes 3 are to be made of carbon paste, the lower electrodes 3 may be formed after the resistor film 5 is formed and before the side electrodes 8 are formed.

FIG. 3 illustrates a chip resistor 11 according to a second embodiment of the present invention.

The chip resistor 11 according to the second embodiment is basically similar to the chip resistor 1 of the first embodiment, but differs from the chip resistor 1 in that the chip resistor 11 is provided with an overcoat 6' covering the cover coat 6. The overcoat 6' is made of a heat-resistant synthetic resin and partially overlaps the auxiliary upper electrodes 7. It is to be noted that the plating layers 9 and the nickel-plated layers 10 are omitted in FIG. 3.

With this structure, the overcoat 6' prevents the airborne sulfur or any other corrosive substance from reaching the upper electrode 4 by passing through the contact portion between the auxiliary upper electrode 7 and the cover coat 6. The overcoat 6' may be formed after the auxiliary upper electrodes 7 are formed and before the layers 9 and 10 are formed.

Figure 5:
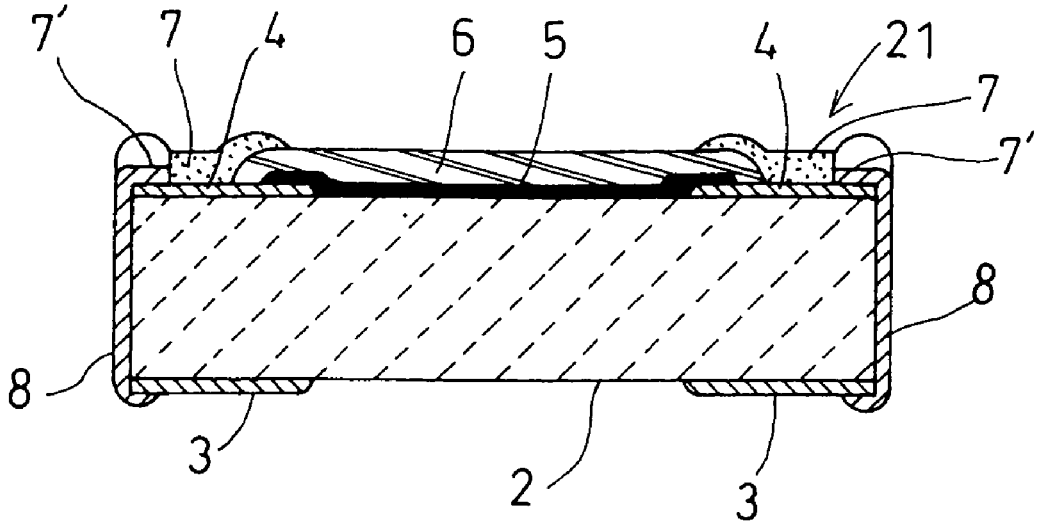
FIG. 5 is a sectional view taken along lines V—V in FIG. 4.
Figure 6:
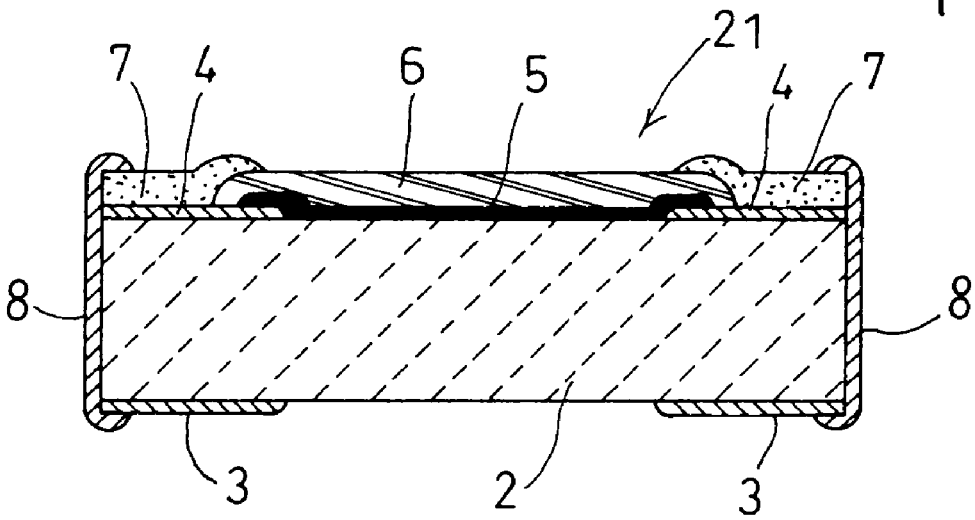
FIG. 6 is a sectional view taken along lines VI—VI in FIG. 4.

FIGS. 4 through 6 illustrate a chip resistor 21 according to a third embodiment of the present invention.

In the chip resistor 21 according to the third embodiment, each of the auxiliary upper electrodes 7 is formed with a cutout 7' (see FIG. 4) for allowing the side electrode 8 to come into direct contact with a part of the upper surface of the upper electrode 4 (see FIG. 5).

With this structure, an electric current can flow from the side electrode 8 to the resistor film 5 via the upper electrode 4 only, that is, without passing through the auxiliary upper electrode 7.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A chip resistor comprising:

an insulating chip substrate including an upper surface and a pair of opposite side surfaces;

a resistor film formed on the upper surface of the insulating substrate;

a pair of upper electrodes formed from silver-based conductive paste on the upper surface of the insulating substrate to be connected to the resistor film;

an outermost cover coat covering the resistor film, the cover coat having a flat upper surface and a tapering edge;

an auxiliary electrode formed on each of the upper electrodes to partially overlap the cover coat;

a side electrode formed on each of the side surfaces of the insulating substrate and electrically connected to one of the upper electrodes and one of the auxiliary upper electrodes a nickel-plated layer covering the auxiliary electrode and the side electrode; and a soldering layer covering the nickel-plated layer and formed of tin or solder;

wherein the side electrode is made of nonmagnetic conductive resin paste, the auxiliary electrode being made of carbon-based conductive resin paste;

wherein the nickel-plated layer and the soldering layer extend onto the flat upper surface of the cover coat beyond the tapering edge; and wherein the auxiliary electrode extends onto the flat upper surface of the cover coat beyond the tapering edge.

2. The chip resistor according to claim 1, wherein the side electrode is made of carbon-based conductive resin paste.

3. The chip resistor according to claim 1, further comprising a pair of lower electrodes formed on a lower surface of the insulating substrate and connected to the side electrodes; wherein the lower electrodes are formed from a carbon-based conductive resin paste and covered with a nickel-plated underlying layer and a soldering layer.

4. The chip resistor according to claim 1, further comprising an overcoat covering the cover coat and partially overlapping the auxiliary electrodes.

5. The chip resistor according to claim 1, wherein the auxiliary electrode is formed with a cutout in which the side electrode is connected to the upper electrode.

6. The chip resistor according to claim 1, wherein each of the auxiliary electrodes has a flat upper surface and a tapering edge, the tapering edge of each auxiliary electrode extending onto the flat upper surface of the cover coat beyond the tapering edge of the cover coat, the flat upper surface of each auxiliary electrode being flush with the flat upper surface of the cover coat.

* * * * *